US006579124B1

(12) United States Patent
Vanbesien

(10) Patent No.: US 6,579,124 B1
(45) Date of Patent: Jun. 17, 2003

(54) SHIELDED ELECTRICAL CONNECTOR

(75) Inventor: Johan Vanbesien, Ieper (BE)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/049,576

(22) PCT Filed: Aug. 1, 2000

(86) PCT No.: PCT/EP00/07447

§ 371 (c)(1),
(2), (4) Date: Jul. 22, 2002

(87) PCT Pub. No.: WO01/13473

PCT Pub. Date: Feb. 22, 2001

(30) Foreign Application Priority Data

Aug. 16, 1999 (DE) ..... 199 38 782

(51) Int. Cl.[7] ..... H01R 13/648
(52) U.S. Cl. ..... 439/608
(58) Field of Search ..... 439/608, 701, 439/108, 101

(56) References Cited

U.S. PATENT DOCUMENTS

| | | | | |
|---|---|---|---|---|
| 5,104,341 A | | 4/1992 | Gilissen et al. | |
| 5,286,212 A | | 2/1994 | Broeksteeg | |
| 5,342,211 A | | 8/1994 | Broeksteeg | |
| 5,788,538 A | | 8/1998 | Belopolsky et al. | |
| 5,795,191 A | | 8/1998 | Preputnick et al. | |
| 6,083,047 A | | 7/2000 | Paagman | |
| 6,293,827 B1 | * | 9/2001 | Stokoe | 439/608 |
| 6,361,366 B1 | * | 3/2002 | Shuey et al. | 439/608 |
| 6,364,710 B1 | * | 4/2002 | Billman et al. | 439/608 |
| 6,500,029 B2 | * | 12/2002 | Nitta | 439/608 |

FOREIGN PATENT DOCUMENTS

| | | |
|---|---|---|
| DE | 4207461 C1 | 1/1993 |
| EP | 0 560 550 B1 | 7/1997 |
| EP | 0 852 414 A2 | 7/1998 |
| WO | WO 99/26321 | 5/1999 |

* cited by examiner

*Primary Examiner*—Gary Paumen
(74) *Attorney, Agent, or Firm*—Baker & Daniels

(57) ABSTRACT

The invention relates to a shielded electrical connector comprising an insulating front housing part (2) and a plurality of juxtaposed contact lamellas (3), said contact lamellas (3) consisting of a mating contact portion (4) received in the front housing part (2), an intermediate portion (5) molded into an insulating material, as well as a rear contact portion (6) following said intermediate portion (5). According to the invention a rear housing part (1) is provided for shielding between the intermediate portions (5); said rear housing part a) receives the intermediate portions (5), b) separates the same from each other in said rear housing part (1) by continuous partition walls (10), and c) the rear housing part (1) is provided with a metallization layer for shielding.

20 Claims, 4 Drawing Sheets

SHIELDED ELECTRICAL CONNECTOR

Figure 1:
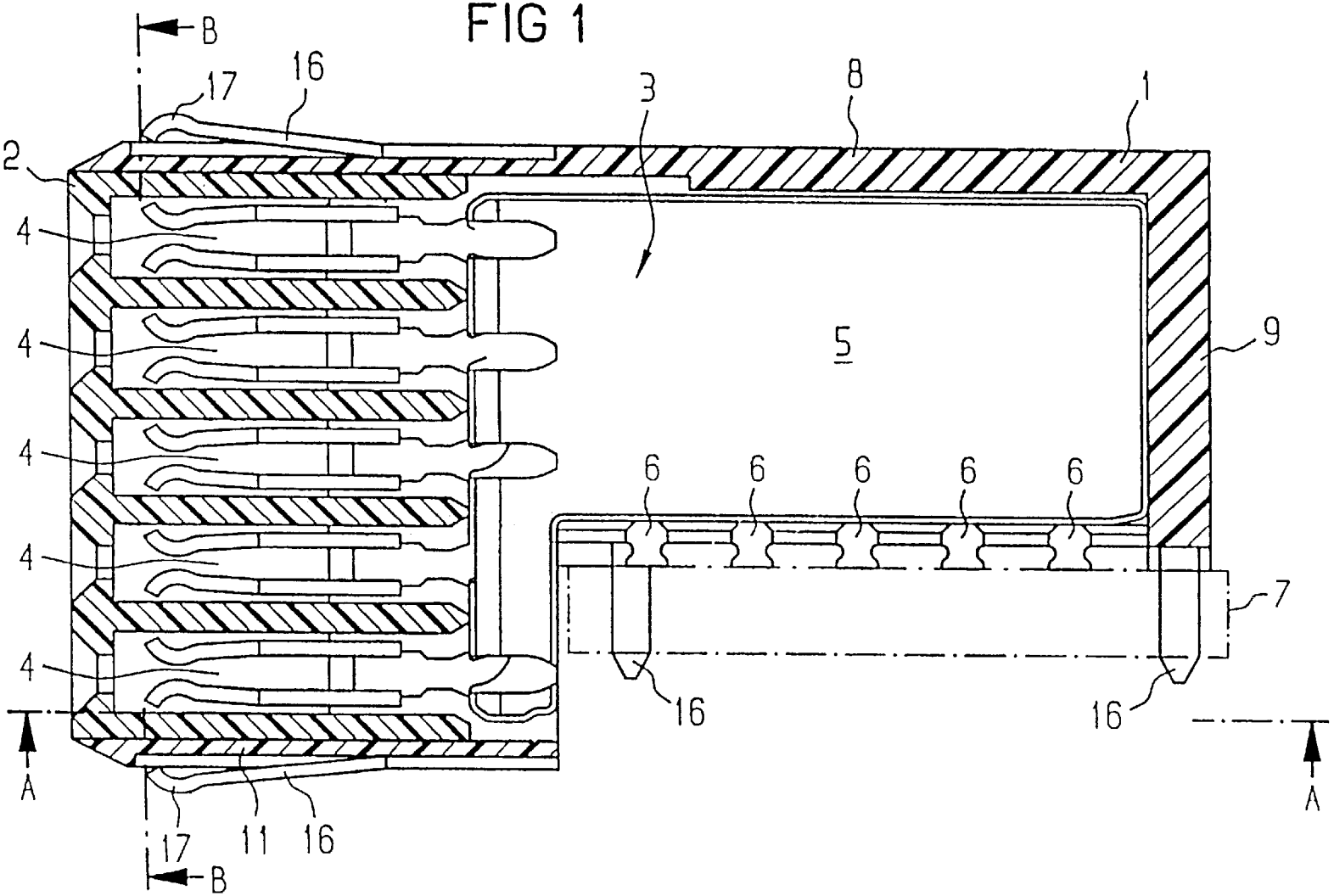

The invention relates to a shielded electrical connector comprising an insulating front housing part and a plurality of juxtaposed contact lamellas, said contact lamellas having a mating contact portion received in the front housing part, an intermediate portion molded into insulating material, as well as a rear contact portion extending away from said intermediate portion, and a shield being provided between the intermediate portions of the contact lamellas as well as on the outsides in the region of the intermediate portions.

Such a shielded electrical connector is known e.g. from EP 0 560 550 B1.

The shield for reducing crosstalk is realized in said connector by sheet metal shielding plates inserted between the intermediate portions of the contact lamellas as well as by sheet metal shielding plates on the outsides in the region of the intermediate portions.

The shielding plates inserted between the intermediate portions have the disadvantage that the dimensions of the connector are increased thereby and that the number of parts in assembling the connector is increased considerably. In particular in case of shielded connectors with a multiplicity of contact lamellas (cf. e.g. FIG. 1 of EP 0 560 550B1), the shielding plates to be inserted between the intermediate portions cause an enormous increase in assembly expenditure.

It is thus the object of the invention to develop the shielded connector according to the generic clause so as to simplify manufacture and reduce the assembly expenditure.

According to the invention, this object is met in that a) the intermediate portions of the contact lamellas are received in a rear housing part, and b) the intermediate portions in said rear housing part are separated from each other via continuous walls, and c) the rear housing part is provided with a metallization layer for shielding.

Due to the accommodation of the intermediate portions of the contact lamellas in a rear housing part that is provided with continuous walls between the contact lamellas, the contact lamellas, during assembly thereof, may easily be inserted into the rear housing part.

By providing the rear housing part with a metallization layer, an ideal shielding effect is achieved between the intermediate portions of the contact lamellas without additional components. The metallization layer does not only facilitate the assembly expenditure, but also provides for production of the shield at considerably lower costs.

In accordance with a preferred embodiment, the continuous walls of the rear housing part extend as tar as into the region of the mating contact portions of the contact lamellas and are received in corresponding recesses in the front housing part.

This measure also reduces crosstalk in the region of the mating contact portions.

Advantageously, the rear housing part has integrally formed thereon a top wall, a rear wall and at least one side wall. Due to this, the number of parts to be assembled is further reduced as the sheet metal shielding plates for the external shield are replaced by the top wall, the rear wall and the at least one side wall. Moreover, an optimum shielding effect is achieved as there are no abutment joints present as in case of composite shielding plates.

For obtaining an external shield also in the region of the mating contact portions, it is advantageous that the top wall and the at least one side wall extend across the front housing part and that a bottom wall connected to the rear housing part is formed in the region of the front housing part as well. As both the top wall, the at least one side wall as well as the bottom wall are provided with a metallization layer, an external shield is easily obtained also in the region of the front housing part and the mating contact portions of the contact lamellas, respectively.

For ground, connection to the mating plug or connector, the bottom and top walls preferably have metallization strips press-fitted therein that are connected to contacts.

When the electrical connector is utilized as a module connector, the bottom side of the rear housing part preferably is provided with pins which also have a metallization layer. These pins on the one hand serve to mechanically fix the electrical connector on the module and on the other hand for transferring the ground connection.

In the following, the invention will be described in more detail by way of an embodiment shown in the drawings.

Figure 2:
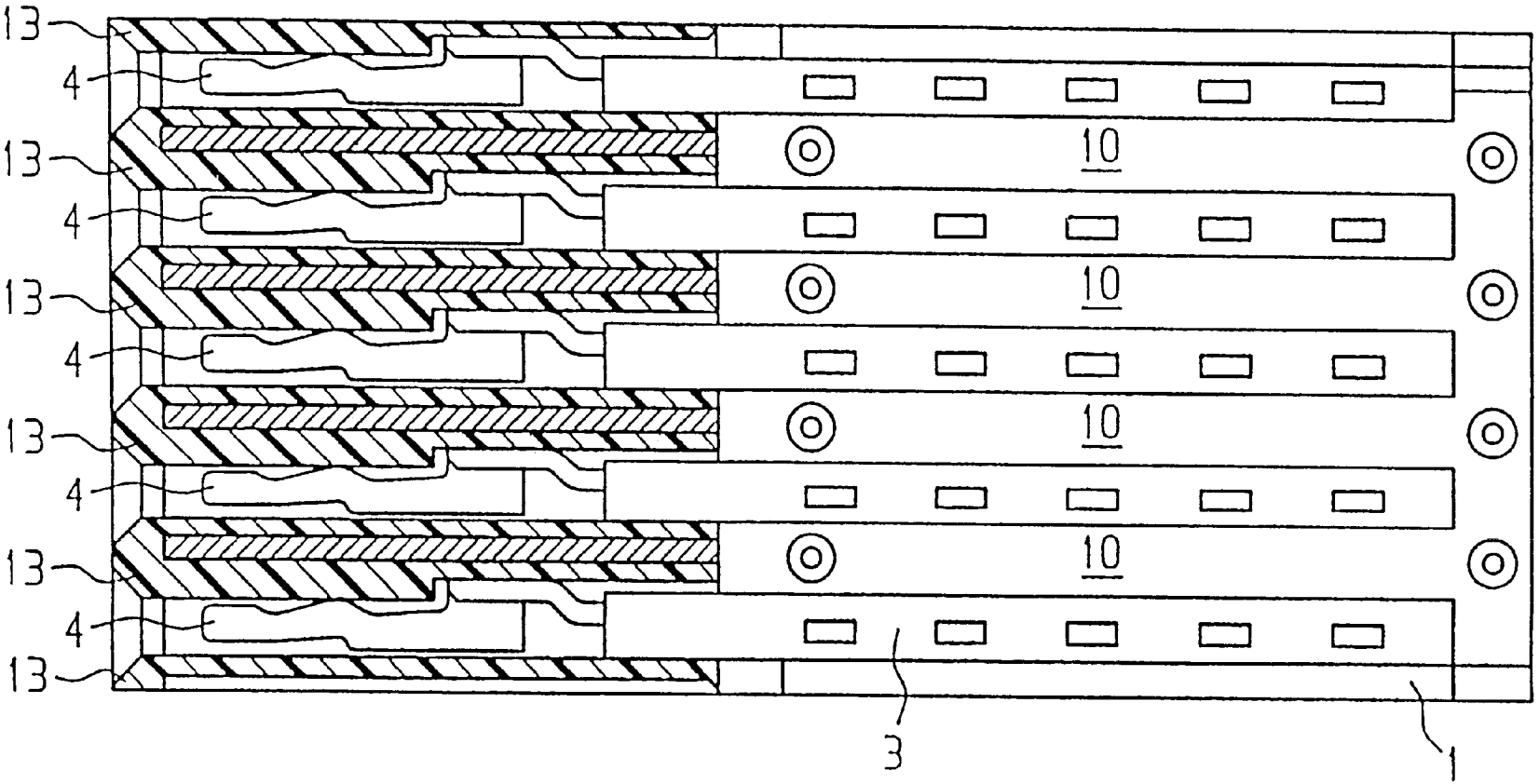
Figure 3:
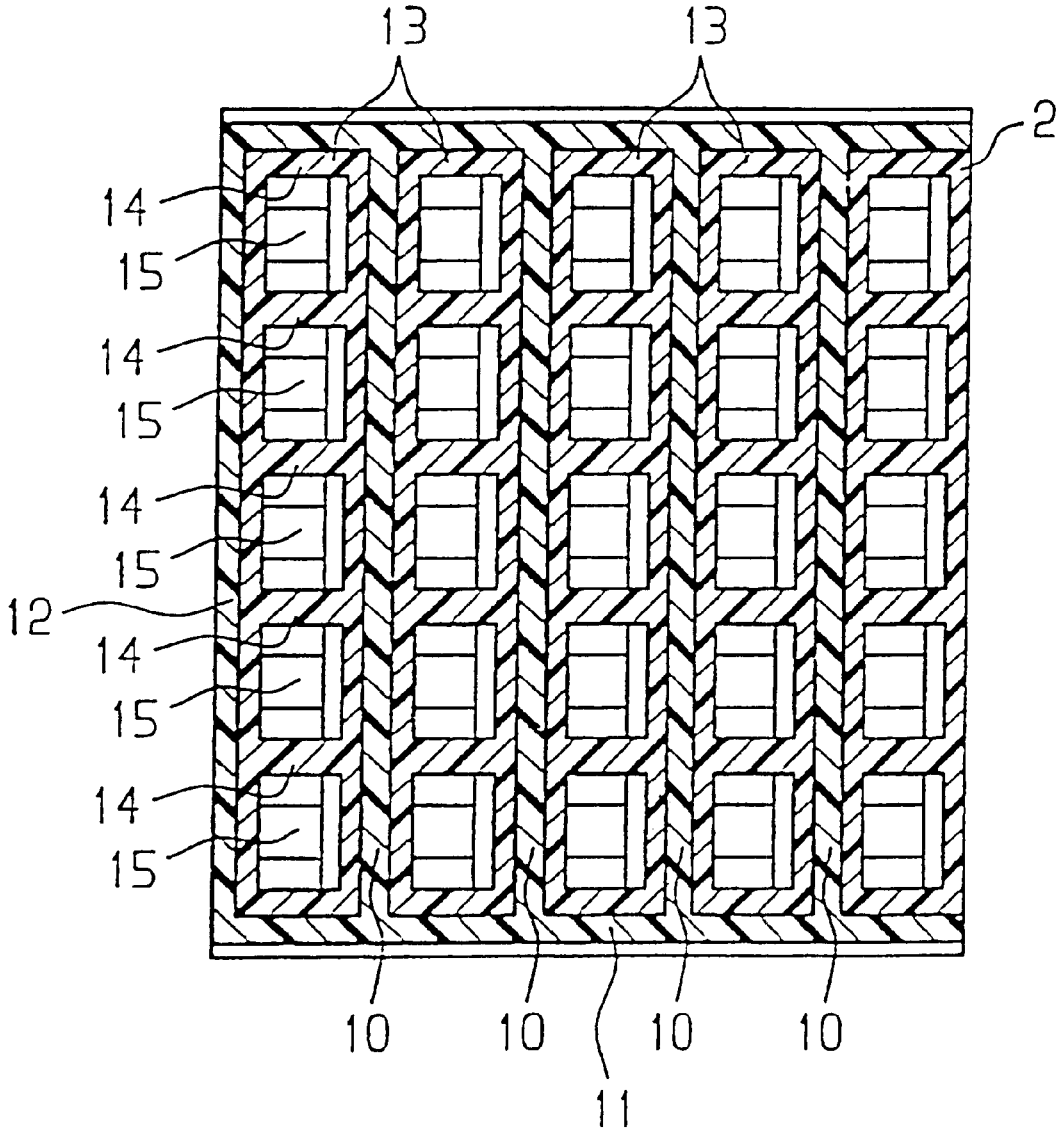
Figure 4:
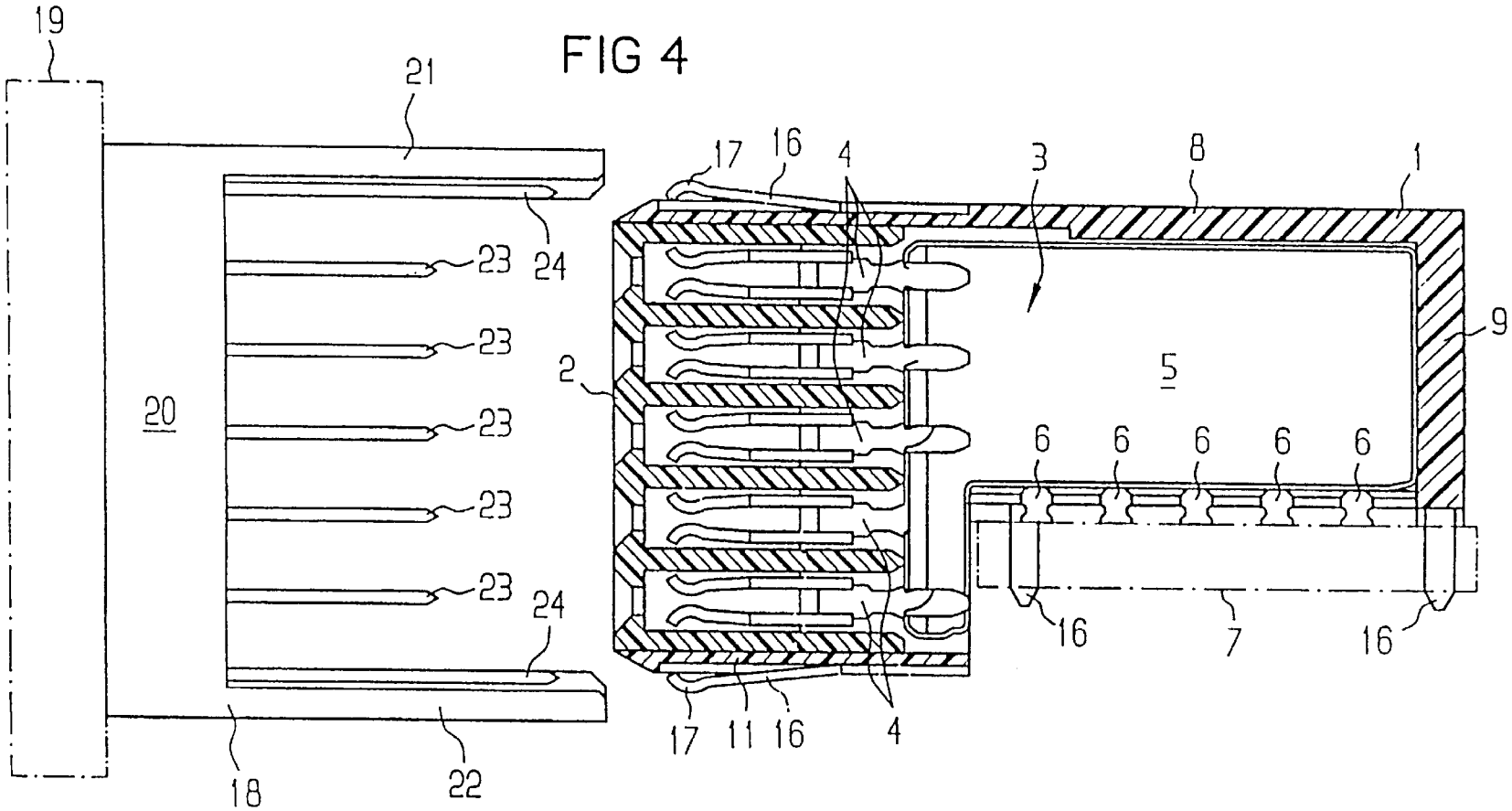

In the drawings:

FIG. 1 shows a sectional side view of the connector according to the invention, FIG. 2 shows a sectional view along the lines A—A of FIG. 1, FIG. 3 shows a sectional view along the lines B—B of FIG. 1, and FIG. 4 shows the electrical connector in the view according to FIG. 1 as well as a side view of the corresponding mating connector.

FIG. 1 shows a sectional side view of the electrical connector according to the invention. This electrical connector consists of a rear housing part 1 and a front housing part 2 as well as a multiplicity of contact lamellas 3 accommodated between the two housing parts. The contact lamellas consist of a mating contact portion 4 constituted by a multiplicity of contact springs. The mating contact portion 4 constituted by the contact springs is followed by an intermediate portion 5 having insulating material injection molded therearound. Arranged on the insulating intermediate portion 5 is a rear contact element 6 which serves for establishing contact with a circuit board or module 7 by way of a series of SMD, push-in or soldering contacts.

The module or package 7 is shown in broken lines in FIG. 1. The contact lamella 3 is surrounded completely by the rear housing part 1. The rear housing part 1 consists of a top wall 8, a rear wall 9 and a multiplicity of continuous partition walls 10 between which the contact lamellas 3 are inserted. The continuous partition walls 10 of the rear housing part 1 are visible in FIGS. 2 and 3 only. FIG. 2 shows a sectional view along the lines A—A of FIG. 1, and FIG. 3 shows a sectional view along the lines B—B of FIG. 1.

The continuous partition walls 10 are not only formed in the region of the intermediate portion 5 of contact lamella 3, but also extend as far as between the contact springs of the mating contact portion 4. In this region, the partition walls 10 are formed to be considerably narrower and are received completely in corresponding recesses in front housing part 2.

The top wall 8 also extends beyond the contact springs of mating contact portion 4 and thus covers front housing part 2 having the contact springs accommodated therein. On the bottom side, in the region of the mating contact portion 4 or in the region where the front housing part 4 is received in the rear housing part 1, there is formed a bottom wall 11.

As can be seen from FIG. 3, bottom wall 11 is connected to top wall 8 via the continuous partition walls 10 as well as via a side wall 12.

To prevent or reduce crosstalk between the individual conductive paths, the entire rear housing pare 1 is provided with a metallization layer.

In contrast thereto, the front housing part 2 is designed to be insulating. However, as the rear housing part 1 extends over the front housing part 2 and the contact springs accommodated in the front housing part 2, good shielding is ensured also in the region of the mating contact portion 4 or between the contact springs.

Front housing part 2 consists of vertical webs 13 and a multiplicity of horizontal webs 14. Between the vertical webs 13 and the horizontal webs 14 there are formed cavities 15 in which the contact springs of the mating contact portion 4 are received in the assembled state. The vertical webs 13 have corresponding U-shaped recesses (cf. FIG. 2) in which the metallized partition walls 10 of rear housing part 1 are introduced in the assembled state. In assembling the electrical connector, the contact lamellas 3 are just slidingly inserted into rear housing part 1, and thereafter front housing part 2 is inserted into rear housing part 1, with the metallized partition walls 10 being slid into the corresponding U-shaped recesses of front housing part 2 and the contact springs are introduced into the respective cavities of front housing part 2.

In the region of intermediate portion 5, pins 16 are formed on the bottom side of the partition walls 10 of rear housing part 1. These pins 16 are provided with a metallization layer as well and serve for mechanical and electrical connection to module 7. To this end, the pins are inserted into through-metallized holes in the module and soldered thereto e.g. by reflow soldering.

For ground connection to a mating plug or connector, the top wall 8 and the bottom wall 11 each have a metal strip 16 press-fitted therein which is slightly bent outwardly across a certain portion so as to be resiliently engaged upon mating thereof with a mating connector.

On the face side, metal strip 16 is provided on its protruding end with a rounded portion 17 so that insertion thereof into the mating connector is facilitated.

FIG. 4 illustrates the electrical connector according to FIG. 1 along with a corresponding mating connector in a side view. The mating connector is designed as backpanel connector 18, with the backpanel 19 being shown in FIG. 4 in broken lines only. Backpanel connector 18 is substantially of U-shaped construction and consists of a bottom wall 20 as well as two side walls 21 and 22. Arranged in bottom wall 20 is a multiplicity of contact blades 23 having the same grid spacing as the contact springs in the module connector.

The side walls 21, 22 have ground contacts 24 arranged on the inside thereof, which, upon insertion of the module connector, resiliently contact the outwardly bent metal strips 16.

What is claimed is:

1. A shielded electrical connector, comprising an insulating front housing part and a plurality of juxtaposed contact lamellas, said contact lamellas each having a mating contact portion received in the front housing part, an intermediate portion molded into insulating material, as well as a rear contact portion extending away from said intermediate portion, and a electrically conductive shield being provided between the intermediate portion, the contact lamellas as well as on the outsides in the region of the intermediate portions, the intermediate portions of the contact lamellas are received in a rear housing part, the intermediate portions in said rear housing part are separated from each other via continuous partition walls, the rear housing is provided with a metallization layer for shielding, and the continuous partition walls of the rear housing part extending as far as to the mating contact portion received in said front housing part.

2. A shielded electrical connector according to claim 1, wherein the front housing part is provided with corresponding recesses into which the continuous partition walls can be slidingly introduced.

3. A shielded electrical connector according to claim 1, wherein the rear housing part comprises a top wall, a rear wall and at least one side wall.

4. A shielded electrical connector according to claim 3, characterized in that the top wall and at least one side wall extend as far as over the front housing part, and in the region of the front housing part there is also formed a bottom wall that is connected to said rear housing part 1.

5. A shielded electrical connector according to claim 4, characterized in that the bottom wall and/or the top wall have a metal strip press-fitted therein that is connected to contacts.

6. A shielded electrical connector according to any of claims 1 to 5, characterized in that the bottom side of the rear housing part is provided with pins that are provided with a metallization layer as well.

7. A shielded electrical connector, comprising:

an insulating front housing having a front and a rear face, said front face having an array of openings for the receipt of a plurality of mating contact pins, and said housing being defined by a matrix of horizontal and vertical walls which define contact receiving cavities opening on to said rear face, each said vertical wall having a slot defined therein, extending inwardly from said rear face;

a plurality of contact members having mating contact portions received in said contact receiving cavities of said front housing part, intermediate portions and rear contact portions extending away from said intermediate portions, each said contact member being arranged in a substantially planar array, and said plurality of said contact members being positioned in an orthogonally arranged manner; and a rear housing portion substantially enclosing said front housing portion, and said rear housing portion including orthogonally arranged electrically conductive shielding walls, having rear shielding portions positioned intermediate to said contact members, and front shielding portions positioned in said slots.

8. A shielded electrical connector according to claim 7, wherein at least the shielding walls of the rear housing portion are provided with a metallized layer.

9. A shielded electrical connector according to claim 7, wherein the rear housing part comprises a top wall, a rear wall and at least one side wall.

10. A shielded electrical connector according to claim 9, wherein the shielding walls are integral with the rear housing portion, and the rear housing portion, including the orthogonally arranged shielding walls, are provided with a metallized layer.

11. A shielded electrical connector according to claim 10, wherein the intermediate portions of said contact members are overmolded with an encapsulating insulating material.

12. A shielded electrical connector according to claim 11, wherein the rear contact portions are defined as printed circuit board contacts.

13. A shielded electrical connector according to claim 12, wherein the rear contact portions are perpendicularly disposed relative to said mating contact portions.

14. A shielded electrical connector, comprising:

a plurality of contact assemblies having mating front contact portions, intermediate portions and rear contact portions extending away from said intermediate portions, each said contact assembly being overmolded with an encapsulating insulating material to enclose at least said intermediate portions, said plurality of contact assemblies being arranged in an orthogonally arranged manner; and a housing member having a top wall, an end wall and side walls, said end wall having a plurality of orthogonally spaced electrically conductive shielding walls extending forwardly therefrom, said shielding walls being positioned intermediate said overmolded portions, providing cross talk shielding between said contact assemblies.

15. A shielded electrical connector according to claim 14, further comprising an insulating front housing positionable over said front contact portions.

16. A shielded electrical connector according to claim 15, wherein said front housing has a front and a rear face, said front face having an array of openings for the receipt of a plurality of mating contact pins, and said housing being defined by a matrix of horizontal and vertical walls which define contact receiving cavities opening on to said rear face, said vertical walls having a slot defined therein, extending inwardly from said rear face to receive said shielding walls therein.

17. A shielded electrical connector according to claim 15, wherein at least the shielding walls of the rear housing portion are provided with a metallized layer.

18. A shielded electrical connector according to claim 17, wherein the shielding walls are integral with rear housing portion, and the rear housing portion, including the orthogonally arranged shielding walls, are provided with a metallized layer.

19. A shielded electrical connector according to claim 14, wherein the rear contact portions are defined as printed circuit board contacts.

20. A shielded electrical connector according to claim 19, wherein the rear contact portions are perpendicularly disposed relative to said mating contact portions, and extend downwardly from said overmolded portions.

* * * * *